US006540485B2

(12) United States Patent
Nara et al.

(10) Patent No.: US 6,540,485 B2
(45) Date of Patent: Apr. 1, 2003

(54) LINEAR COMPRESSOR

(75) Inventors: Kenichi Nara, Nisshin (JP); Yasumasa Hagiwara, Nisshin (JP); Takashi Murase, Nisshin (JP)

(73) Assignee: Cryodevice Inc., Aichi (JP)

( * ) Notice: Subject to any disclaimer, the term of this patent is extended or adjusted under 35 U.S.C. 154(b) by 0 days.

(21) Appl. No.: 09/940,717

(22) Filed: Aug. 29, 2001

(65) Prior Publication Data

US 2002/0028143 A1 Mar. 7, 2002

(30) Foreign Application Priority Data

Aug. 31, 2000 (JP) ..... 2000-263819

(51) Int. Cl.[7] ..... F04B 49/06

(52) U.S. Cl. ..... 417/44.1; 417/415; 417/417; 310/12; 318/135

(58) Field of Search ..... 417/44.1, 415, 417/416, 417; 310/12, 51; 318/135, 687

(56) References Cited

U.S. PATENT DOCUMENTS 5,564,536 A * 10/1996 Lai ..... 188/379

6,079,960 A * 6/2000 Funatsu et al. ..... 417/488

FOREIGN PATENT DOCUMENTS

JP 411294878 A * 10/1999

* cited by examiner

*Primary Examiner*—Charles G. Freay
*Assistant Examiner*—John F Belena
(74) *Attorney, Agent, or Firm*—Richard L. Aitken; Venable

(57) ABSTRACT

A linear compressor, comprises a fixed member formed with a hermetically sealed compression chamber, a movable member axially movably received in the compression chamber of the fixed member, a plurality of resilient members each intervening between the fixed member and the movable member, driving means for driving the movable member, damping means for damping vibrations of the fixed member, the damping means including a retaining member fixedly connected to the fixed member and a weight member axially movably supported by the retaining member, first detecting means for detecting a displacement of the movable member, second detecting means for detecting a displacement of the weight member, and controlling means for controlling the driving means to have the movable member perform a reciprocally linear motion to ensure that the vibrations of the fixed member are damped by the damping means.

12 Claims, 8 Drawing Sheets

LINEAR COMPRESSOR

BACKGROUND OF THE INVENTION

1. Field of the Invention

The present invention relates to a linear compressor available for a pulse tube type of cooling machine, and more particularly to a linear compressor equipped with a linear motor to drive a single piston unit forming part of the linear compressor to have the single piston unit perform a reciprocally linear motion. The present invention is concerned with an improved linear compressor so constructed as to ensure that the linear compressor effectively prevents vibrations thereof from being caused by a reciprocally linear motion of the single piston unit.

2. Description of the Related Art

Up until now, there have been proposed a wide variety of conventional linear compressors each equipped with a pair of linear motors to drive a pair of piston units forming part of the linear compressor to have each of the piston units perform a reciprocally linear motion.

The conventional linear compressors of this type have so far been available for such a pulse tube type of cooling machine for cooling a superconducting material used for an electronic component. The conventional linear compressor is operatively connected to the pulse tube type of cooling machine to have the pulse tube type of cooling machine supplied with a working fluid periodically compressed and decompressed by the conventional linear compressor.

One typical example of the conventional linear compressors is exemplified and shown in FIG. 8. The conventional linear compressor 200 thus proposed comprises a casing member 201 formed with a casing chamber 202, and a fixed member 203 accommodated in the casing chamber 202 of the casing member 201 and fixedly supported by the casing member 201. The fixed member 203 is formed with a hermetically sealed compression chamber 204 to receive a working fluid therein and an inlet-outlet port 205 having the working fluid introduced therein and discharged therefrom.

The conventional linear compressor 200 further comprises a connecting pipe 206 formed with a passageway therein and connected at one end to the fixed member 203 with the passageway held in communication with the inlet-outlet port 205 of the fixed member 203. The connecting pipe 206 is connected at the other end to the pulse tube type of cooling machine to have the working fluid fed to the pulse tube type of cooling machine through the passageway.

The conventional linear compressor 200 further comprises a pair of piston units 207 and 208 each including a piston head 207*a* and 208*a* axially movably received in the compression chamber 204 of the fixed member 203 and a piston rod 207*b* and 208*b* axially movably supported by the fixed member 203. The piston rods 207*b* and 208*b* are respectively connected to the piston heads 207*a* and 208*a* to have each of the piston heads 207*a* and 208*a* axially move in the compression chamber 204 of the fixed member 203. Each of the piston units 207 and 208 is axially movable with respect to the fixed member 203 under a reciprocally linear motion. The piston units 207 and 208 are located in symmetrical relationship with each other with respect to the compression chamber 204. The conventional linear compressor thus constructed is generally called "opposed piston type of linear compressor".

The conventional linear compressor 200 further comprises a plurality of resilient members 209 to 212 each intervening between the fixed member 203 and each of the piston units 207 and 208 to have the fixed member 203 and each of the piston units 207 and 208 resiliently connected with each other, and a pair of linear motors 213 and 214 designed to drive the piston units 207 and 208, respectively. Each of the linear motors 213 and 214 has an electromagnet unit 213*a* and 214*a* respectively mounted on the piston rods 207*b* and 208*b*, and a permanent magnet unit 213*b* and 214*b* supported by the fixed member 203 to have each of the piston units 207 and 208 perform the reciprocally linear motion. The linear motor thus constructed is generally called "moving coil type of linear motor".

The conventional linear compressor thus constructed, i.e., the opposed piston type of linear compressor, however, encounters the problem that the conventional linear compressor cannot be reduced in size, resulting from the fact that the large space of the conventional linear compressor is occupied by the pair of piston units located in symmetrical relationship with each other. This type of linear compressor further encounters the a problem that the conventional linear compressor is complicated in construction and thus expensive in production cost, resulting from the fact that the conventional linear compressor comprises the pair of piston units.

While it has been described in the above that the conventional linear compressor comprises a pair of piston units, the pair of piston units may be replaced by a single piston unit in order to have the conventional linear compressor reduced in size. The conventional linear compressor thus constructed is generally called "single piston type of linear compressor". This type of linear compressor, however, encounters the problem that the reciprocally linear motion of the single piston unit causes detrimental vibrations bringing mechanical failure brought to the conventional linear compressor.

Though the conventional linear compressor has been described in the above as being equipped with at least one of the moving coil type of linear motors, each of the moving coil type of linear motors may be replaced by a linear motor having a permanent magnet unit mounted on the piston rod and an electromagnet unit supported by the fixed member. The linear motor thus constructed is generally called "moving magnet type of linear motor". This type of linear motor is disclosed in the Japanese Patent Laid-Open Publication No. 6-189518. The conventional linear compressor equipped with at least one of the moving magnet type of linear motors, however, encounters the same problems as the conventional linear compressor equipped with the moving coil type of linear motor described in the above.

SUMMARY OF THE INVENTION

It is therefore a primary object of the present invention to provide a linear compressor that can effectively prevent the vibrations of the fixed member from being caused by the reciprocally linear motion of the single piston unit forming part of the linear compressor.

It is another object of the present invention to provide a linear compressor that can be reduced in size.

It is further object of the present invention to provide a linear compressor that can be simple in construction and thus inexpensive in production cost.

In accordance with one aspect of the present invention, there is provided a linear compressor, comprising: a fixed member formed with a hermetically sealed compression chamber to receive a working fluid therein; a movable member axially movably received in the compression chamber of the fixed member, the movable member axially movably supported by the fixed member to have the movable member axially move in the compression chamber of the fixed member; a plurality of resilient members each intervening between the fixed member and the movable member to have the fixed member and the movable member resiliently connected with each other, the movable member being axially movable with respect to the fixed member under a reciprocally linear motion to assume three different positions consisting of a compression position in which the working fluid is compressed by the movable member, a decompression position in which the working fluid is decompressed by the movable member, and a neutral position in which the movable member is resiliently retained by the resilient member s with respect to the fixed member under no influence of the working fluid in the compression chamber of the fixed member, driving means for driving the movable member at a predetermined driving frequency to have the movable member perform the reciprocally linear motion; damping means for damping vibrations of the fixed member caused by the reciprocally linear motion of the movable member, the damping means including a retaining member fixedly connected to the fixed member, a weight member axially movably supported by the retaining member to resonate with the vibrations of the casing member, and a resilient member intervening between the retaining member and the weight member to have the retaining member and the weight member resiliently connected with each other, first detecting means for detecting a displacement of the movable member with respect to the fixed member, the first detecting means being operative to produce a first displacement signal indicative of the displacement of the movable member; second detecting means for detecting a displacement of the weight member with respect to the retaining member, the second detecting means being operative to produce a second displacement signal indicative of the displacement of the weight member, and controlling means for controlling the predetermined driving frequency of the driving means to have the movable member perform the reciprocally linear motion at a predetermined phase difference between the first displacement signal produced by the first detecting means and the second displacement signal produced by the second detecting means to ensure that the vibrations of the fixed member are damped by the damping means when the movable member is driven by the driving means.

The linear compressor may further comprise an offset detecting means for detecting an offset of the movable member with respect to the neutral position of the movable member based on the first displacement signal produced by the first detecting means and second displacement signal produced by the second detecting means, the offset detecting means being operative to eliminate a signal component indicative of the offset of the movable member from the first displacement signal produced by the first detecting means when the offset of the movable member is detected by the offset detecting means.

The amplitudes of the movable member and the weight member may be coincident with each other.

The first detecting means may include an optical sensor having a photo emitter for emitting a light beam and a photo detector for detecting the light beam emitted from the photo emitter to the photo detector, the optical sensor being operative to produce the first displacement signal when the light beam emitted from the photo emitter to the photo detector passes over the movable member.

The second detecting means may include an optical sensor having a photo emitter for emitting a light beam and a photo detector for detecting the light beam emitted from the photo emitter to the photo detector, the optical sensor being operative to produce the second displacement signal when the light beam emitted from the photo emitter to the photo detector is interrupted by the weight member.

Each of the resilient members may include a plurality of leaf springs each having a plane extending perpendicular to the center axis of the movable member, each of the resilient members having a first portion fixedly connected to the movable member, and a second portion fixedly connected to the fixed member to ensure that the movable member is resiliently urged with respect to the fixed member toward the neutral position while the movable member is axially moved to the compression position and the decompression position thereof.

The driving means may include a linear motor having a first magnet unit in the form of an annular shape and mounted on the piston rod, and a second magnet unit in the form of an annular shape and supported by the fixed member, the first and second magnet units having respective center axes each held in coaxial relationship with the center axis of the movable member, and respective center planes each perpendicular to the center axis of the movable member, the center plane of the first magnet unit being on the center plane of the second magnet unit when the movable member assumes the neutral position.

The first and second magnet units may be constituted by an electromagnet and a permanent magnet, respectively, to ensure that the movable member is driven by the linear motor at the predetermined driving frequency of the electromagnet.

The damping means may be connected to the fixed member with the center axis of the weight member held in axial alignment with the center axis of the movable member.

The damping means may be connected to the fixed member with the center axis of the weight member held in parallel relationship with the center axis of the movable member.

The predetermined phase difference may be 180 degrees.

BRIEF DESCRIPTION OF THE DRAWINGS

The features and advantages of a linear compressor according to the present invention will more clearly be understood from the following description taken in conjunction with the accompanying drawings in which.

DESCRIPTION OF THE PREFERRED EMBODIMENTS

Figure 1:
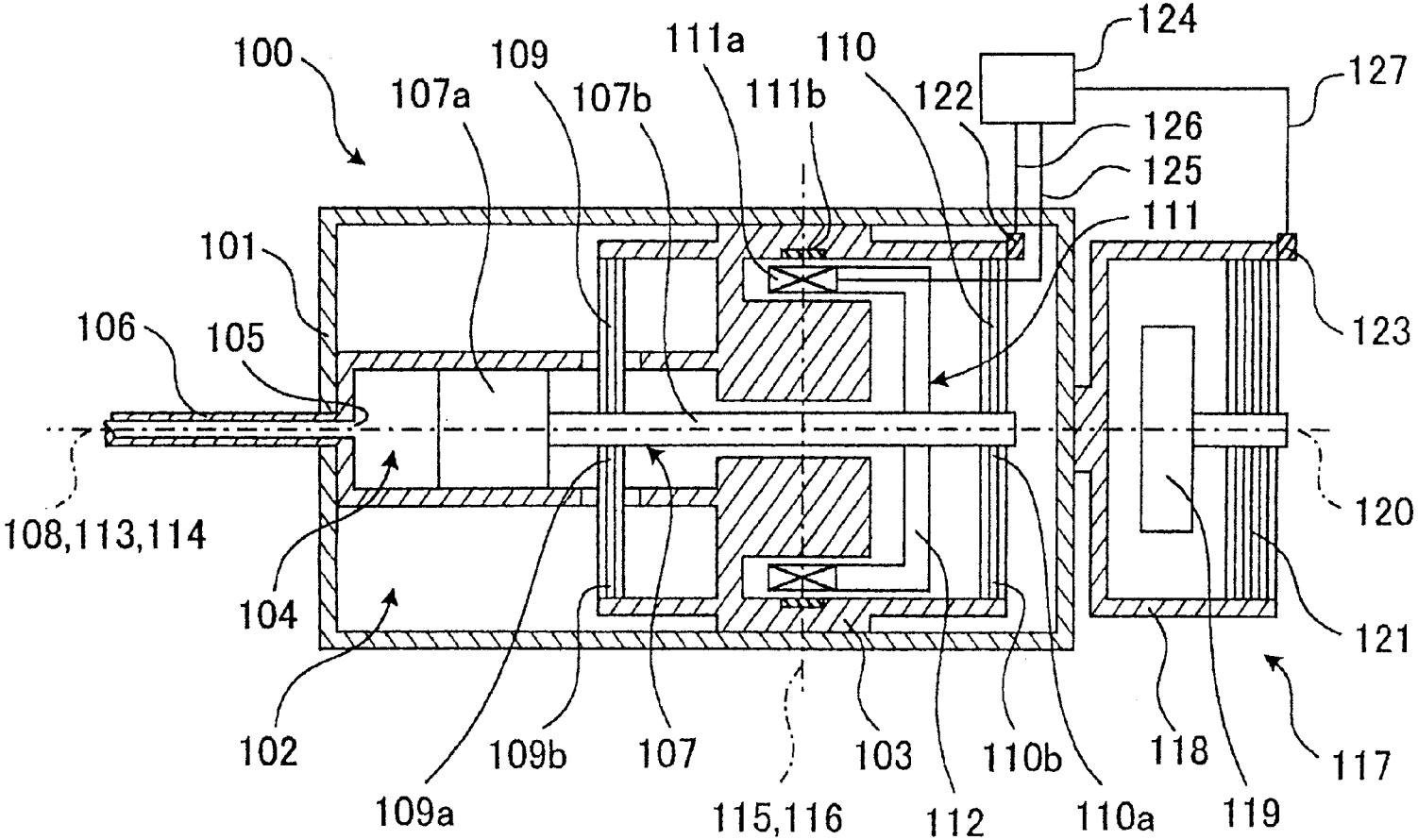
FIG. 1 is a longitudinal sectional view of one preferred embodiment of the linear compressor according to the present invention.

One of the preferred embodiments of the linear compressor according to the present invention will now be described in detail in accordance with the accompanying drawings.

Referring now to the drawings, in particular to FIGS. 1 to 7, here are shown one of preferred embodiments of the linear compressor according to the present invention. The linear compressor 100 is available for a pulse tube type of cooling machine for cooling a superconducting material used for an electronic component. The linear compressor 100 is operatively connected to the pulse tube type of cooling machine to have the pulse tube type of cooling machine supplied a working fluid periodically compressed and decompressed by the linear compressor 100. The linear compressor 100 comprises a casing member 101 formed with a casing chamber 102 in the form of a cylindrical shape, and a fixed member 103 accommodated in the casing chamber 102 of the casing member 101 and fixedly supported by the casing member 101. The fixed member 103 is formed with a hermetically sealed compression chamber 104 in the form of a cylindrical shape to receive a working fluid therein, and an inlet-outlet port 105 having the working fluid introduced therein and discharged therefrom.

The linear compressor 100 further comprises a connecting pipe 106 formed with a passageway therein and connected at one end to the fixed member 103 with the passageway held in communication with the inlet-outlet port 105 of the fixed member 103. The connecting pipe 106 is connected at the other end to the pulse tube type of cooling machine to have the working fluid fed to the pulse tube type of cooling machine through the passageway.

The linear compressor 100 further comprises a movable member which is constituted by a piston unit 107. The piston unit 107 includes a piston head 107*a* in the form of a cylindrical shape and axially movably received in the compression chamber 104 of the fixed member 103, and a piston rod 107*b* in the form of a cylindrical shape and axially movably supported by the fixed member 103. The piston rod 107*b* is connected to the piston head 107*a* to have the piston head 107*a* axially move in the compression chamber 104 of the fixed member 103. The piston head 107*a* and the piston rod 107*b* have respective center axes held in axial alignment with each other. The center axes of the piston head 107*a* and the piston rod 107*b* constitutes a center axis 108 of the piston unit 107. The linear compressor 100 thus constructed is generally called "single piston type of linear compressor".

The linear compressor 100 further comprises a plurality of resilient members 109 and 110 each intervening between the fixed member 103 and the piston unit 107 to have the fixed member 103 and the piston unit 107 resiliently connected with each other. The resilient members 109 and 110 are axially spaced apart from each other along the center axis 108 of the piston unit 107. Each of the resilient members 109 and 110 includes a plurality of leaf springs each having a plane extending perpendicular to the center axis 108 of the piston unit 107.

The piston unit 107 is axially movable with respect to the fixed member 103 under a reciprocally linear motion to assume three different positions consisting of a compression position in which the working fluid is compressed and discharged out of the compression chamber 104 of the fixed member 103 by the piston head 107*a* of the piston unit 107 through the inlet-outlet port 105, a decompression position in which the working fluid is decompressed and introduced in the compression chamber 104 of the fixed member 103 by the piston head 107*a* of the piston unit 107 through the inlet-outlet port 105, and a neutral position in which the piston unit 107 is resiliently retained by the resilient members 109 and 110 with respect to the fixed member 103 under no influence of the working fluid in the compression chamber 104 of the fixed member 103.

Each of the resilient members 109 and 110 has a first portion 109*a* and 110*a* fixedly connected to the piston rod 107*b* of the piston unit 107, and a second portion 109*b* and 110*b* fixedly connected to the fixed member 103 to ensure that the piston unit 107 is resiliently urged with respect to the fixed member 103 toward the neutral position while the piston unit 107 is axially moved to the compression position and the decompression position thereof.

The linear compressor 100 further comprises driving means which is constituted by a linear motor 111. The linear motor 111 is designed to drive the piston unit 107 at a predetermined driving frequency to have the piston unit 107 perform the reciprocally linear motion along the center axis 108 of the piston unit 107. The linear motor 111 has a first magnet unit 111*a* in the form of an annular shape and fixedly mounted on the piston rod 107*b* of the piston unit 107 through a magnet frame 112, and a second magnet unit 111*b* in the form of an annular shape and fixedly supported by the fixed member 103.

The first and second magnet units 111*a* and 111*b* has respective center axes 113 and 114 each held in coaxial relationship with the center axis 108 of the piston unit 107, and respective center planes 115 and 116 each perpendicular to the center axis 108 of the piston unit 107. The center plane 115 of the first magnet unit 111*a* is on the center plane 116 of the second magnet unit 111*b* when the piston unit 107 assumes the neutral position. The first magnet unit 111*a* is constituted by an electromagnet 111*a*, while the second magnet unit 111*b* is constituted by a permanent magnet 111*b* to ensure that the piston unit 107 is driven by the linear motor 111 at a driving frequency of the electromagnet 111*a*. The linear motor 111 thus constructed is generally called "moving coil type of linear motor".

While it has been described about the above embodiment that the first and second magnet units 111*a* and 111*b* are constituted by the electromagnet 111*a* and the permanent magnet 111*b*, respectively, as shown in FIG. 1, the first and second magnet units 111*a* and 111*b* may be constituted by a permanent magnet and an electromagnet, respectively, according to the present invention. The linear motor 111 thus constructed is generally called "moving magnet type of linear motor".

The linear compressor 100 further comprises damping means which is constituted by a dynamic damper 117. The dynamic damper 117 is designed to damp vibrations of the fixed member 103 caused by the reciprocally linear motion of the piston unit 107. The dynamic damper 117 includes a retaining member 118 fixedly connected to the fixed member 103 through the casing member 101, a weight member 119 having a center axis 120 and axially movably supported by the retaining member 118 to resonate with the vibrations of the fixed member 103, and a resilient member 121 intervening between the retaining member 118 and the weight member 119 to have the retaining member 118 and the weight member 119 resiliently connected with each other. The weight member 119 is axially movable with respect to the retaining member 118 to assume three different positions consisting of a close position in which the weight member 119 is close to the piston unit 107, a remote position in which the weight member 119 is remote from the piston unit 107, and a central position in which the weight member 119 is located on the center between the close position and the remote position.

The dynamic damper 117 is connected to the fixed member 103 through the casing member 101 with the center axis 120 of the weight member 119 held in axial alignment with the center axis 108 of the piston unit 107 to ensure that the vibrations of the fixed member 103 are effectively damped by the dynamic damper 117 when the piston unit 107 is driven by the linear motor 111. In addition, the amplitudes of the piston unit 107 and the weight member 119 are adjusted to be coincident with each other within a tolerance of 5 percent to ensure that the vibrations of the fixed member 103 are effectively damped by the dynamic damper 117 when the piston unit 107 is driven by the linear motor 111.

While it has been described in the above embodiment that the dynamic damper 117 is connected to the fixed member 103 through the casing member 101 with the center axis 120 of the weight member 119 held in axial alignment with the center axis 108 of the piston unit 107 as shown in FIG. 1, the dynamic damper 117 may be connected to the fixed member 103 through the casing member 101 with the center axis 120 of the weight member 119 held in parallel relationship with the center axis 108 of the piston unit 107 according to the present invention.

The linear compressor 100 further comprises first detecting means which is constituted by a first optical sensor 122. The first optical sensor 122 is designed to detect a displacement of the piston unit 107 with respect to the fixed member 103. The first optical sensor 122 is operative to produce a first displacement signal indicative of the displacement of the piston unit 107. The first optical sensor 122 has a photo emitter for emitting a light beam and a photo detector for detecting the light beam emitted from the photo emitter to the photo detector. The first optical sensor 122 is operative to produce the first displacement signal when the light beam emitted from the photo emitter to the photo detector passes over the piston unit 107.

The linear compressor 100 further comprises second detecting means which is constituted by a second optical sensor 123. The second optical sensor 123 is designed to detect a displacement of the weight member 119 with respect to the retaining member 118. The second optical sensor 123 is operative to produce a second displacement signal indicative of the displacement of the weight member 119. The second optical sensor 123 has a photo emitter for emitting a light beam and a photo detector for detecting the light beam emitted from the photo emitter to the photo detector. The second optical sensor 123 is operative to produce the second displacement signal when the light beam emitted from the photo emitter to the photo detector is interrupted by the weight member 119.

The linear compressor 100 further comprises controlling means which is constituted by a controlling unit 124. The controlling unit 124 is designed to control the driving frequency of the electromagnet 111*a* of the linear motor 111 to have the piston unit 107 perform the reciprocally linear motion at a predetermined phase difference between the first displacement signal produced by the first optical sensor 122 and the second displacement signal produced by the second optical sensor 123 to ensure that the vibrations of the fixed member 103 are damped by the dynamic damper 117 when the piston unit 107 is driven by the linear motor 111. The controlling unit 124 is operative to apply an alternating current to the electromagnet 111*a* of the linear motor 111. The predetermined phase difference between the first and second displacement signals is set at 180 degrees.

The linear compressor 100 further comprises an offset detecting means which is constituted by the controlling unit 124. The controlling unit 124 is designed to detect an offset of the piston unit 107 with respect to the neutral position of the piston unit 107 based on the first displacement signal produced by the first optical sensor 122 and second displacement signal produced by the second optical sensor 123. The controlling unit 124 is operative to eliminate a signal component indicative of the offset of the piston unit 107 from the first displacement signal produced by the first optical sensor 122 when the offset of the piston unit 107 is detected by the controlling unit 124.

The controlling unit 124 is electrically connected to the electromagnet 111*a* of the linear motor 111 to apply the alternating current through transmitting line 125. The controlling unit 124 is electrically connected to the first optical sensor 122 to receive the first displacement signal through transmitting line 126. The controlling unit 124 is electrically connected to the second optical sensor 123 to receive the second displacement signal through transmitting line 127.

The operation of the linear compressor 100 will be described hereinafter with reference to the flowchart shown in FIG. 2.

Figure 2:
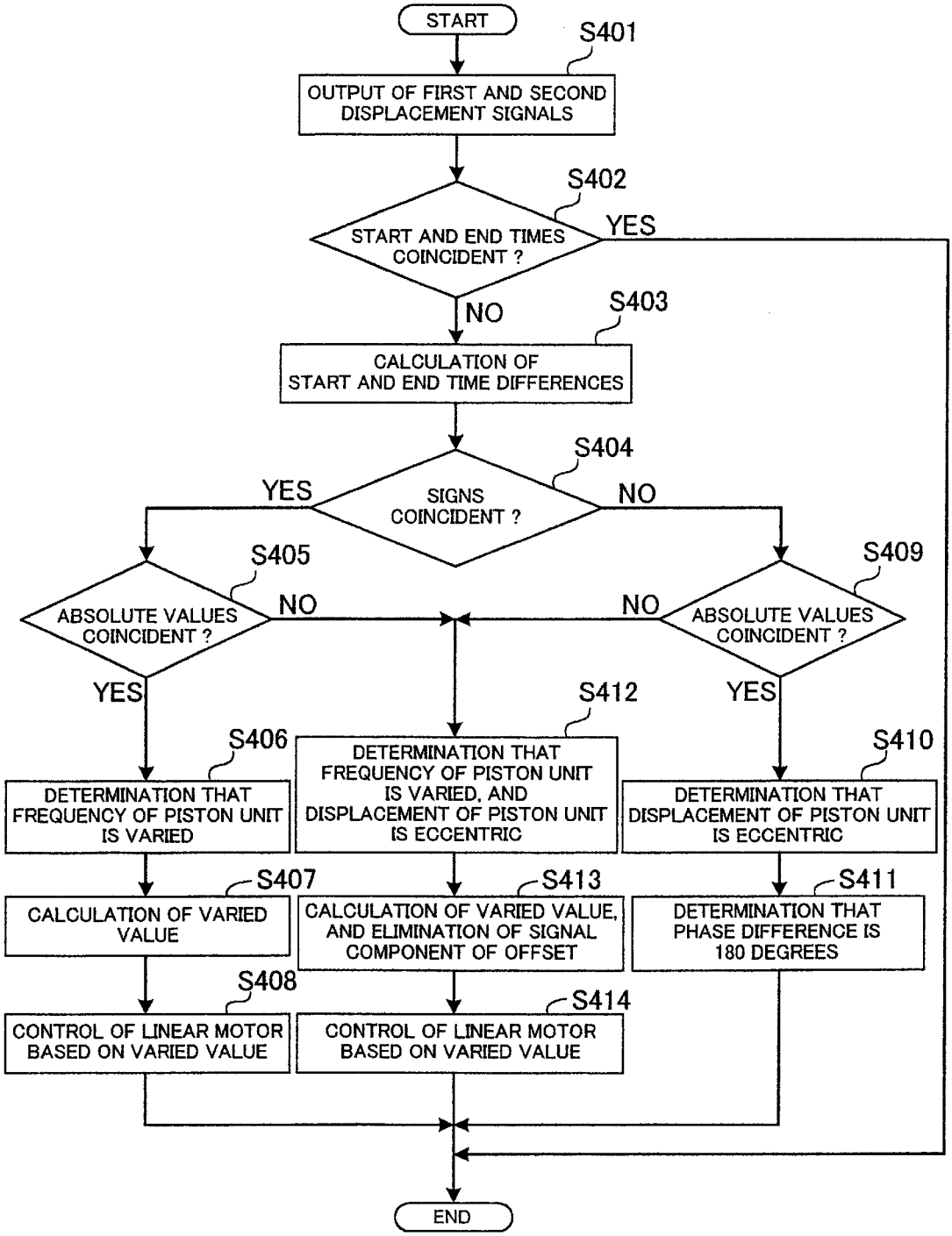
FIG. 2 is a flowchart showing a process performed by the linear compressor shown in FIG. 1.

The flowchart appearing in FIG. 2 shows steps to be performed by one of the preferred embodiments of the linear compressor 100 according to the present invention, however, the steps according to the present invention are not limited to these steps.

Figure 3:
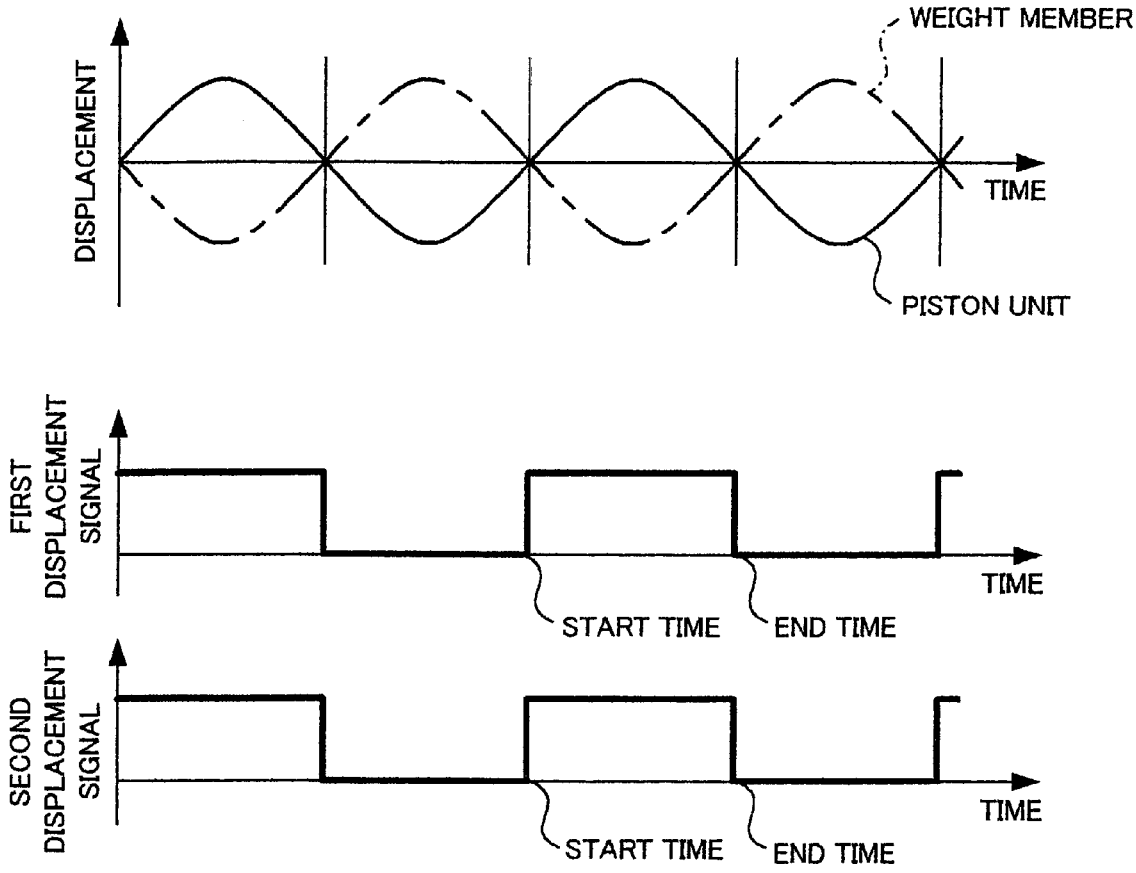
FIG. 3 is a waveform chart showing the displacements of the piston unit and the weight member, and the first and second displacement signals produced by the first and second optical sensors each forming part of the linear compressor shown in FIG. 1.

Referring now to FIGS. 2 and 3, the following description will be directed to the case that the phase difference between the first and second displacement signals coincidents with the predetermined phase difference of 180 degrees.

In step S401, the first optical sensor 122 is operated to output the first displacement signal indicative of the displacement of the piston unit 107 to the transmitting line 126 when the first optical sensor 122 is operated to detect the piston unit 107 located between the compression position and the neutral position. The first displacement signal thus outputted to the transmitting line 126 is then inputted to the controlling unit 124 through the transmitting line 126. The fact that the first optical sensor 122 is operated to output the first displacement signal to the transmitting line 126 when the first optical sensor 122 is operated to detect the piston unit 107 located between the compression position and the neutral position leads to the fact that the first displacement signal indicates the detecting period of the piston unit 107 located between the compression position and the neutral position.

Simultaneously with the first optical sensor 122 operated to output the first displacement signal to the transmitting line 126 in step S401, the second optical sensor 123 is operated to output the second displacement signal indicative of the displacement of the weight member 119 to the transmitting line 127 when the second optical sensor 123 is operated to detect the weight member 119 located between the remote position and the central position. The second displacement signal thus outputted to the transmitting line 127 is then inputted to the controlling unit 124 through the transmitting line 127. The fact that the second optical sensor 123 is operated to output the second displacement signal to the transmitting line 127 when the second optical sensor 123 is operated to detect the weight member 119 located between the remote position and the central position leads to the fact that the second displacement signal indicates the detecting period of the weight member 119 located between the remote position and the central position.

In step S402, the controlling unit 124 is operated to determine whether the start and end times of the detecting period of the first displacement signal each coincident with the start and end times of the detecting period of the second displacement signal or not. The fact that the controlling unit 124 is operated to determine whether the start and end times of the detecting period of the first displacement signal each coincident with the start and end times of the detecting period of the second displacement signal or not leads to the fact that the controlling unit 124 is operated to determine whether the phase difference between the first and second displacement signals is varied from the predetermined phase difference of 180 degrees or not.

When the controlling unit 124 is operated to determine that the start and end times of the detecting period of the first displacement signal each coincident with the start and end times of the detecting period of the second displacement in step S402, the controlling unit 124 is operated to determine that the phase difference between the first and second displacement signals coincidents with the predetermined phase difference of 180 degrees at the end. The fact that the phase difference between the first and second displacement signals coincidents with the predetermined phase difference of 180 degrees leads to the fact that the vibrations of the fixed member 103 are damped by the dynamic damper 117 when the piston unit 107 is driven by the linear motor. The step that the start and end times of the detecting period of the first displacement signal each disaccord with the start and end times of the detecting period of the second displacement will appear as the description proceeds.

Figure 4:
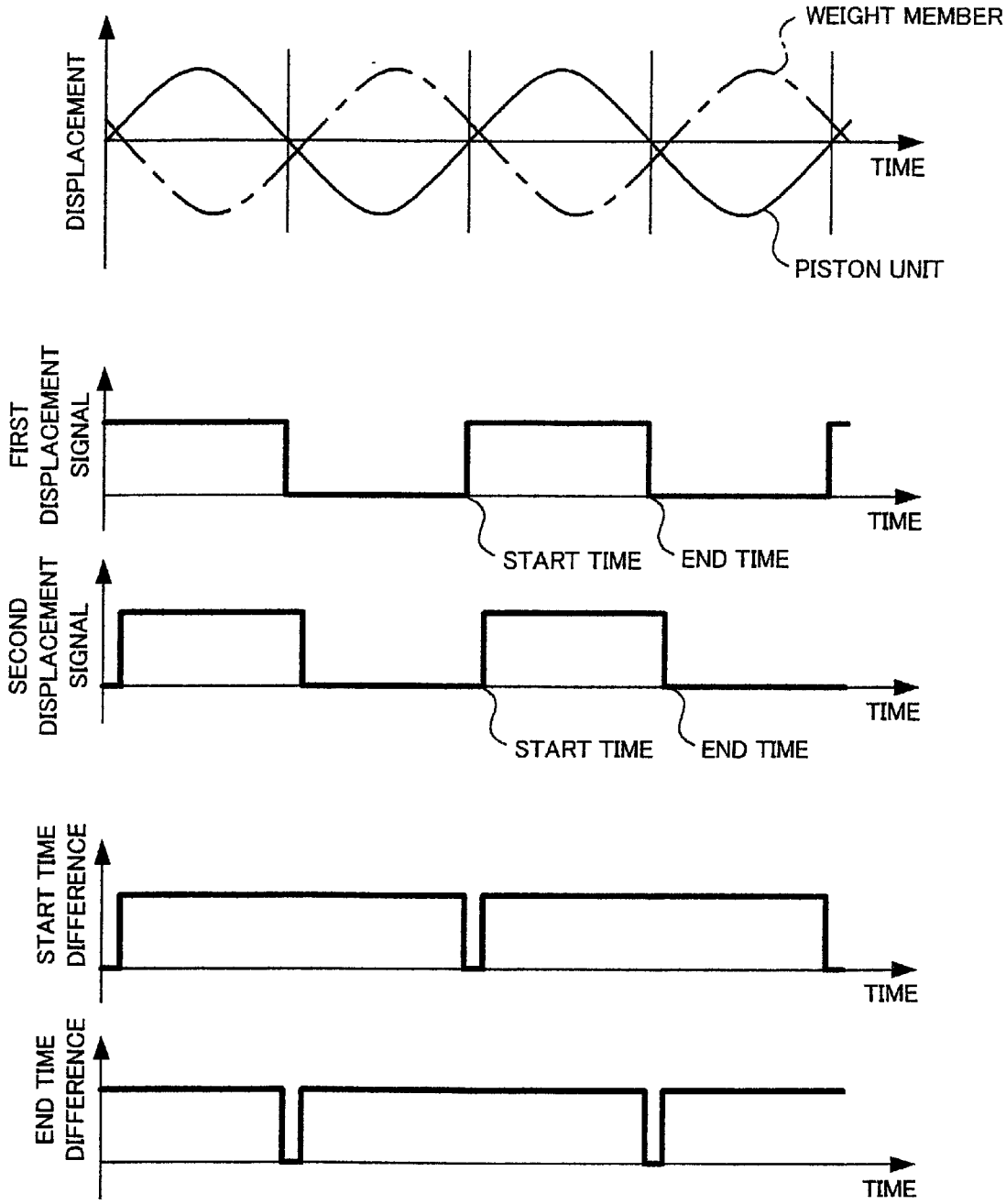
FIG. 4 is a waveform chart showing the displacements of the piston unit and the weight member, the first and second displacement signals produced by the first and second optical sensors, and the start and end time differences calculated by the controlling unit each forming part of the linear compressor shown in FIG. 1.
Figure 5:
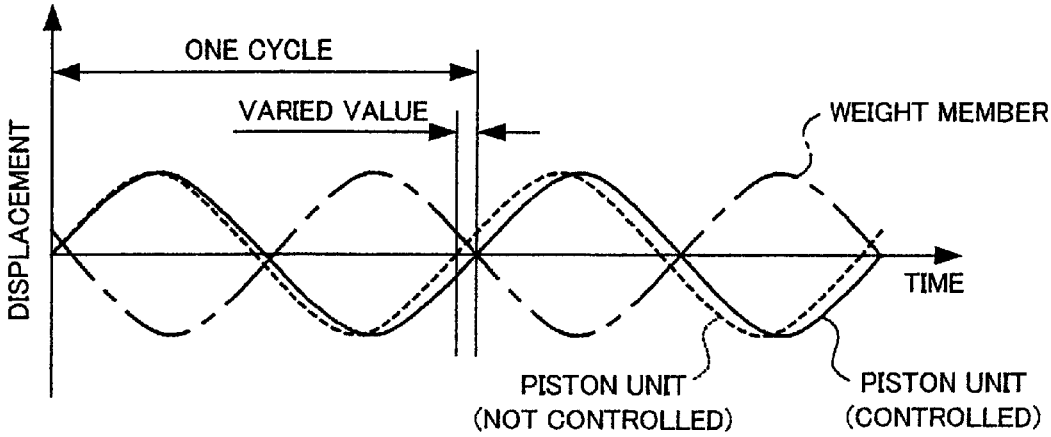
FIG. 5 is a waveform chart explaining the control of the phase difference between the displacements of the piston unit and the weight member each forming part of the linear compressor shown in FIG. 1.

Referring then to FIGS. 2, 4 and 5, the following description will be directed to the case that the phase difference between the first and second displacement signals is varied from the predetermined phase difference of 180 degrees, resulting from the fact that the frequency of the piston unit 107 is varied from the frequency of the weight member 119.

In step S401, the first optical sensor 122 is operated to output the first displacement signal indicative of the displacement of the piston unit 107 to the transmitting line 126 when the first optical sensor 122 is operated to detect the piston unit 107 located between the compression position and the neutral position. The first displacement signal thus outputted to the transmitting line 126 is then inputted to the controlling unit 124 through the transmitting line 126. The fact that the first optical sensor 122 is operated to output the first displacement signal to the transmitting line 126 when the first optical sensor 122 is operated to detect the piston unit 107 located between the compression position and the neutral position leads to the fact that the first displacement signal indicates the detecting period of the piston unit 107 located between the compression position and the neutral position.

Simultaneously with the first optical sensor 122 operated to output the first displacement signal to the transmitting line 126 in step S401, the second optical sensor 123 is operated to output the second displacement signal indicative of the displacement of the weight member 119 to the transmitting line 127 when the second optical sensor 123 is operated to detect the weight member 119 located between the remote position and the central position. The second displacement signal thus outputted to the transmitting line 127 is then inputted to the controlling unit 124 through the transmitting line 127. The fact that the second optical sensor 123 is operated to output the second displacement signal to the transmitting line 127 when the second optical sensor 123 is operated to detect the weight member 119 located between the remote position and the central position leads to the fact that the second displacement signal indicates the detecting period of the weight member 119 located between the remote position and the central position.

In step S402, the controlling unit 124 is operated to determine whether the start and end times of the detecting period of the first displacement signal each coincident with the start and end times of the detecting period of the second displacement signal or not. The fact that the controlling unit 124 is operated to determine whether the start and end times of the detecting period of the first displacement signal each coincident with the start and end times of the detecting period of the second displacement signal or not leads to the fact that the controlling unit 124 is operated to determine whether the phase difference between the first and second displacement signals is varied from the predetermined phase difference of 180 degrees or not.

When the controlling unit 124 is operated to determine that the start and end times of the detecting period of the first displacement signal each disaccord with the start and end times of the detecting period of the second displacement in step S402, the controlling unit 124 is operated to calculate the start and end time differences between the first and second displacement signals in step S403.

The start time difference calculated in step S403 is the difference when the start time of the detecting period of the second displacement signal is subtracted from the start time of the detecting period of the first displacement signal. This means that the start time difference is positive when the start time of the detecting period of the first displacement signal is delayed from the start time of the detecting period of the second displacement signal, while the start time difference is negative when the start time of the detecting period of the first displacement signal proceeds from the start time of the detecting period of the second displacement signal.

The end time difference calculated in step S403 is also the difference when the end time of the detecting period of the second displacement signal is subtracted from the end time of the detecting period of the first displacement signal. This means that the end time difference is positive when the end time of the detecting period of the first displacement signal is delayed from the end time of the detecting period of the second displacement signal, while the end time difference is negative when the end time of the detecting period of the first displacement signal proceeds from the end time of the detecting period of the second displacement signal.

In step S404, the controlling unit 124 is operated to determine whether the signs of the start and end time differences coincident with each other or not. When the controlling unit 124 is operated to determine that the signs of the start and end time differences coincident with each other in step S404, the controlling unit 124 is operated to determine whether the absolute values of the start and end time differences coincident with each other or not in step S405. The step that the signs of the start and end time differences disaccord with each other will appear as the description proceeds.

When the controlling unit 124 is operated to determine that the absolute values of the start and end time differences coincident with each other in step S405, the controlling unit 124 is operated to determine that the phase difference between the first and second displacement signals is varied from the predetermined phase difference of 180 degrees, resulting from the fact that the frequency of the piston unit 107 is varied from the frequency of the weight member 119 in step S406. The step that the absolute values of the start and end time differences disaccord with each will appear as the description proceeds.

In step S407, the controlling unit 124 is operated to calculate the varied value of the phase difference from the predetermined phase difference of 180 degrees. The varied value calculated in step S407 is the sum of the start and end time differences, divided by 2.

In step S408, the controlling unit 124 is operated to control the driving frequency of the electromagnet 111*a* of the linear motor 111 on the basis of the varied value of the phase difference from the predetermined phase difference of 180 degrees at the end. This means that the controlling unit 124 is operated to control the frequency of the piston unit 107 for one cycle of the reciprocally linear motion of the piston unit 107 to ensure that the piston unit 107 is operated to perform the reciprocally linear motion at the predetermined phase difference of 180 degrees as shown in FIG. 5. The fact that the piston unit 107 is operated to perform the reciprocally linear motion at the predetermined phase difference of 180 degrees leads to the fact that the vibrations of the fixed member 103 are damped by the dynamic damper 117 when the piston unit 107 is driven by the linear motor 111.

Figure 6:
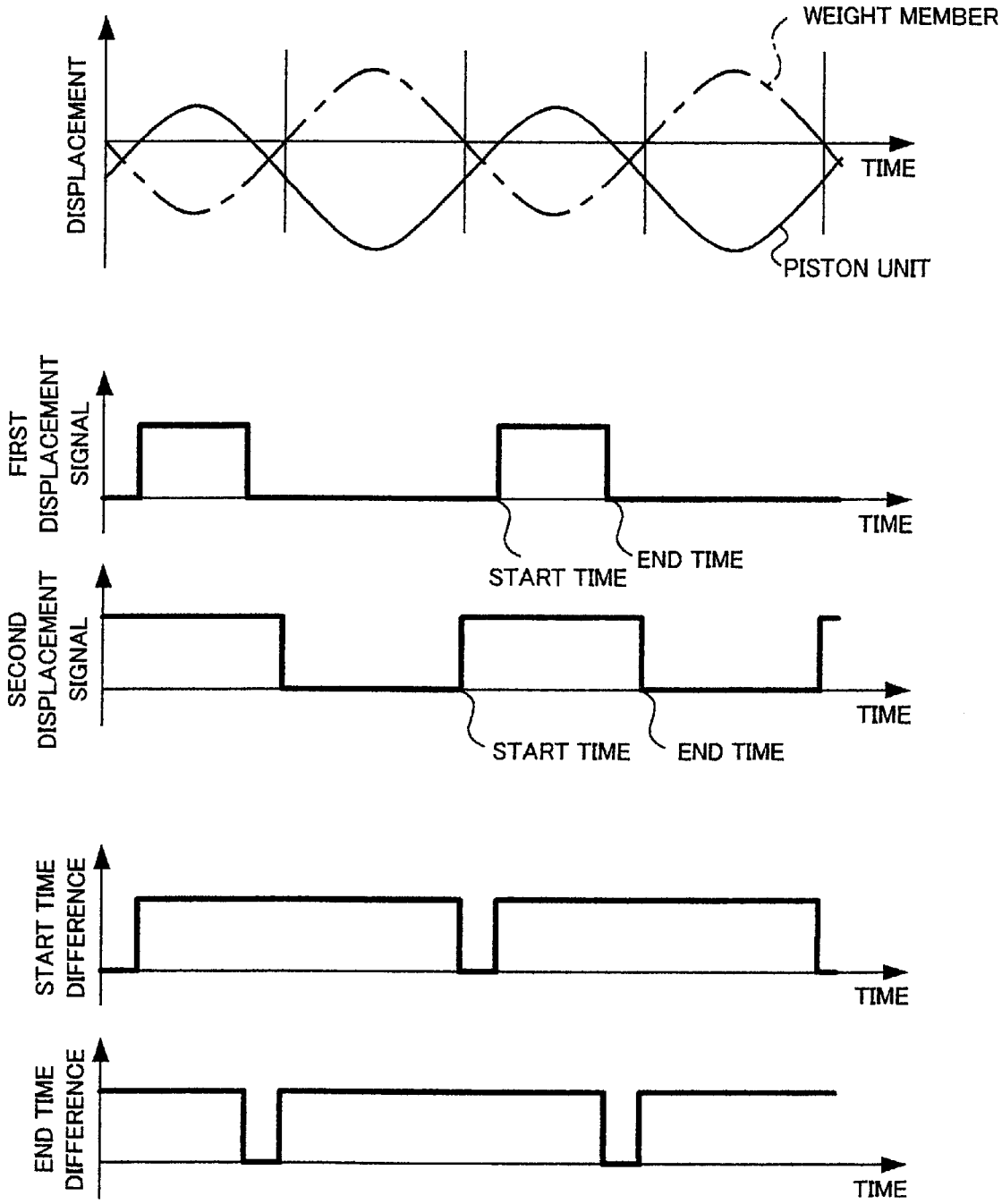
FIG. 6 is a waveform chart similar to FIG. 4 but showing another case of the displacements of the piston unit and the weight member, the first and second displacement signals produced by the first and second optical sensors, and the start and end time differences calculated by the controlling unit each forming part of the linear compressor shown in FIG. 1.

Referring then to FIGS. 2 and 6, the following description will be directed to the case that the phase difference between the first and second displacement signals is varied from the predetermined phase difference of 180 degrees, resulting from the fact that the displacement of the piston unit 107 is eccentric to the neutral position of the piston unit 107 as the offset of the piston unit 107. This means that the first displacement signal indicative of the displacement of the piston unit 107 contains the signal component indicative of the offset of the piston unit 107. In this case, the phase difference between the first and second displacement signals is observed as being varied from the predetermined phase difference of 180 degrees.

In step S401, the first optical sensor 122 is operated to output the first displacement signal indicative of the displacement of the piston unit 107 to the transmitting line 126 when the first optical sensor 122 is operated to detect the piston unit 107 located between the compression position and the neutral position. The first displacement signal thus outputted to the transmitting line 126 is then inputted to the controlling unit 124 through the transmitting line 126. The fact that the first optical sensor 122 is operated to output the first displacement signal to the transmitting line 126 when the first optical sensor 122 is operated to detect the piston unit 107 located between the compression position and the neutral position leads to the fact that the first displacement signal indicates the detecting period of the piston unit 107 located between the compression position and the neutral position.

Simultaneously with the first optical sensor 122 operated to output the first displacement signal to the transmitting line 126 in step S401, the second optical sensor 123 is operated to output the second displacement signal indicative of the displacement of the weight member 119 to the transmitting line 127 when the second optical sensor 123 is operated to detect the weight member 119 located between the remote position and the central position. The second displacement signal thus outputted to the transmitting line 127 is then inputted to the controlling unit 124 through the transmitting line 127. The fact that the second optical sensor 123 is operated to output the second displacement signal to the transmitting line 127 when the second optical sensor 123 is operated to detect the weight member 119 located between the remote position and the central position leads to the fact that the second displacement signal indicates the detecting period of the weight member 119 located between the remote position and the central position.

In step S402, the controlling unit 124 is operated to determine whether the start and end times of the detecting period of the first displacement signal each coincident with the start and end times of the detecting period of the second displacement signal or not. The fact that the controlling unit 124 is operated to determine whether the start and end times of the detecting period of the first displacement signal each coincident with the start and end times of the detecting period of the second displacement signal or not leads to the fact that the controlling unit 124 is operated to determine whether the phase difference between the first and second displacement signals is varied from the predetermined phase difference of 180 degrees or not.

When the controlling unit 124 is operated to determine that the start and end times of the detecting period of the first displacement signal each disaccord with the start and end times of the detecting period of the second displacement in step S402, the controlling unit 124 is operated to calculate the start and end time differences between the first and second displacement signals in step S403.

The start time difference calculated in step S403 is the difference when the start time of the detecting period of the second displacement signal is subtracted from the start time of the detecting period of the first displacement signal. This means that the start time difference is positive when the start time of the detecting period of the first displacement signal is delayed from the start time of the detecting period of the second displacement signal, while the start time difference is negative when the start time of the detecting period of the first displacement signal proceeds from the start time of the detecting period of the second displacement signal.

The end time difference calculated in step S403 is also the difference when the end time of the detecting period of the second displacement signal is subtracted from the end time of the detecting period of the first displacement signal. This means that the end time difference is positive when the end time of the detecting period of the first displacement signal is delayed from the end time of the detecting period of the second displacement signal, while the end time difference is negative when the end time of the detecting period of the first displacement signal proceeds from the end time of the detecting period of the second displacement signal.

In step S404, the controlling unit 124 is operated to determine whether the signs of the start and end time differences coincident with each other or not. When the controlling unit 124 is operated to determine that the signs of the start and end time differences disaccord with each other in step S404, the controlling unit 124 is operated to determine whether the absolute values of the start and end time differences coincident with each other or not in step S409.

When the controlling unit 124 is operated to determine that the absolute values of the start and end time differences coincident with each other in step S409, the controlling unit 124 is operated to determine that the phase difference between the first and second displacement signals is varied from the predetermined phase difference of 180 degrees, resulting from the fact that the displacement of the piston unit 107 is eccentric to the neutral position of the piston unit 107 as the offset of the piston unit 107 in step S410. The step that the absolute values of the start and end time differences disaccord with each will appear as the description proceeds.

In step S411, the controlling unit 124 is operated to determine that the piston unit 107 is operated to perform the reciprocally linear motion at the predetermined phase difference of 180 degrees, while the displacement of the piston unit 107 is eccentric to the neutral position of the piston unit 107 as the offset of the piston unit 107 at the end. The fact that the piston unit 107 is operated to perform the reciprocally linear motion at the predetermined phase difference of 180 degrees leads to the fact that the vibrations of the fixed member 103 are damped by the dynamic damper 117 when the piston unit 107 is driven by the linear motor 111.

Figure 7:
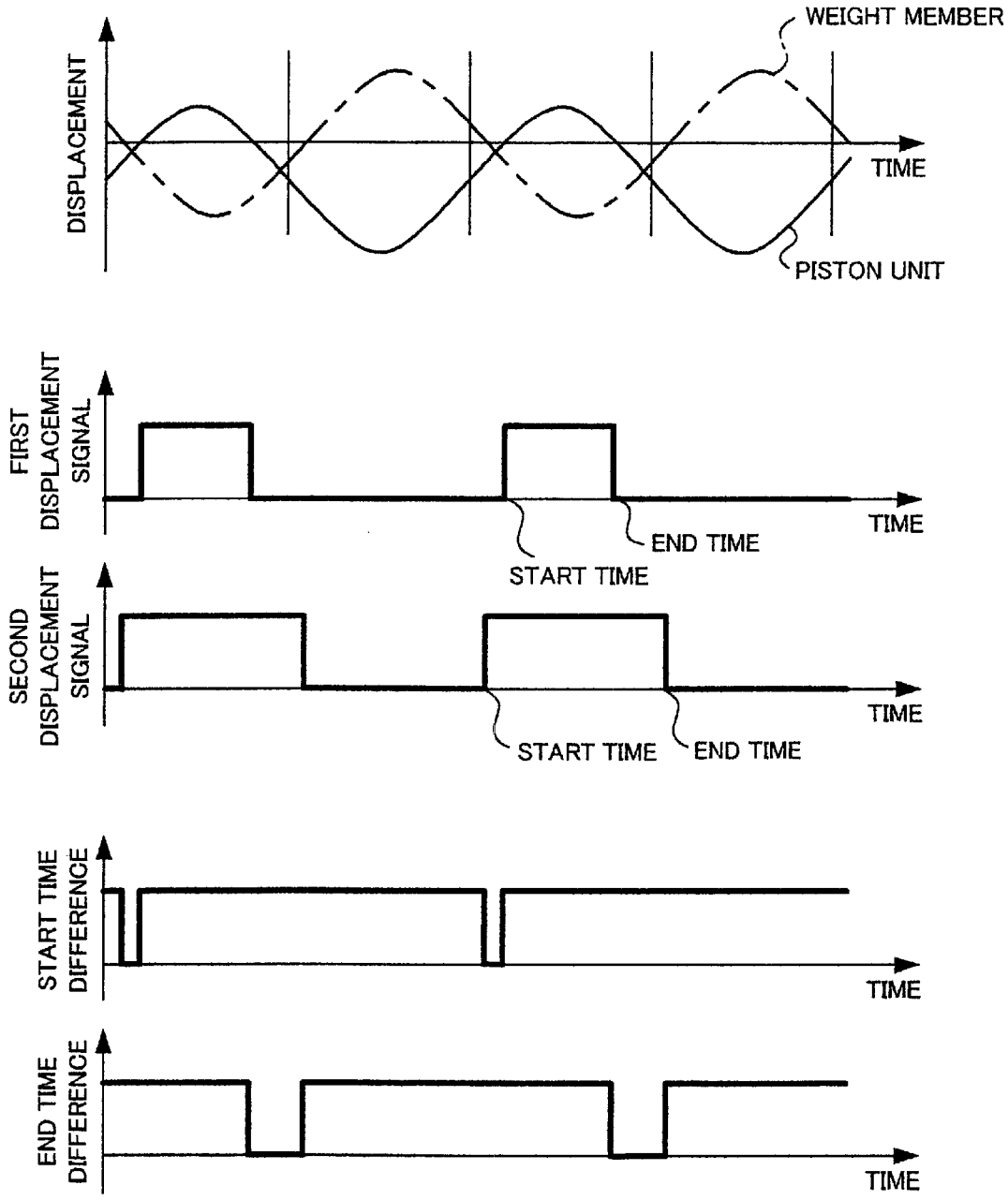
FIG. 7 is a waveform chart similar to FIG. 4 but showing another case of the displacements of the piston unit and the weight member, the first and second displacement signals produced by the first and second optical sensors, and the start and end time differences calculated by the controlling unit each forming part of the linear compressor shown in FIG. 1.
Figure 8:
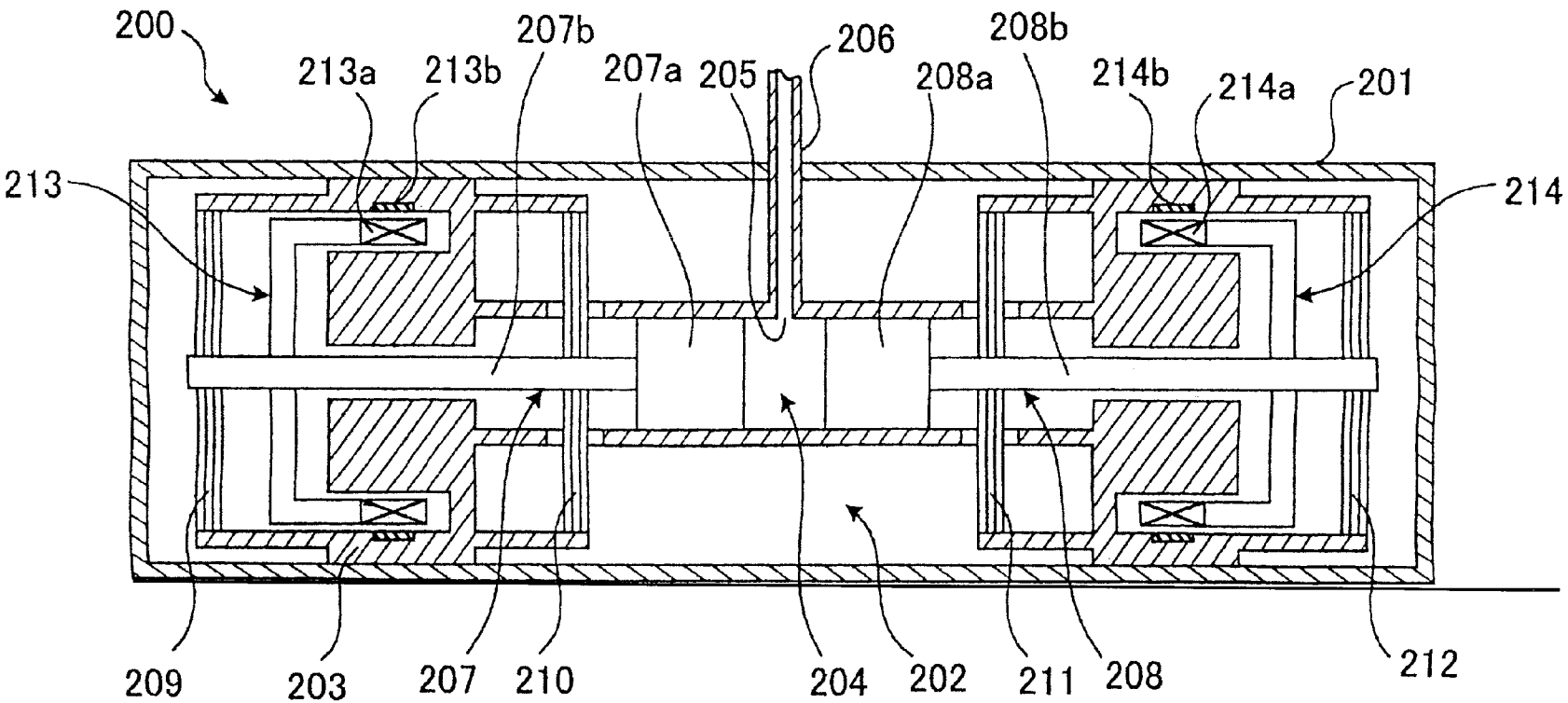
FIG. 8 PRIOR ART
FIG. 8 is a longitudinal sectional view of the conventional linear compressor.

Referring then to FIGS. 2, and 7, the following description will be directed to the case that the phase difference between the first and second displacement signals is varied from the predetermined phase difference of 180 degrees, resulting from the fact that the frequency of the piston unit 107 is varied from the frequency of the weight member 119, and the displacement of the piston unit 107 is eccentric to the neutral position of the piston unit 107 as the offset of the piston unit 107.

In step S401, the first optical sensor 122 is operated to output the first displacement signal indicative of the displacement of the piston unit 107 to the transmitting line 126 when the first optical sensor 122 is operated to detect the piston unit 107 located between the compression position and the neutral position. The first displacement signal thus outputted to the transmitting line 126 is then inputted to the controlling unit 124 through the transmitting line 126. The fact that the first optical sensor 122 is operated to output the first displacement signal to the transmitting line 126 when the first optical sensor 122 is operated to detect the piston unit 107 located between the compression position and the neutral position leads to the fact that the first displacement signal indicates the detecting period of the piston unit 107 located between the compression position and the neutral position.

Simultaneously with the first optical sensor 122 operated to output the first displacement signal to the transmitting line 126 in step S401, the second optical sensor 123 is operated to output the second displacement signal indicative of the displacement of the weight member 119 to the transmitting line 127 when the second optical sensor 123 is operated to detect the weight member 119 located between the remote position and the central position. The second displacement signal thus outputted to the transmitting line 127 is then inputted to the controlling unit 124 through the transmitting line 127. The fact that the second optical sensor 123 is operated to output the second displacement signal to the transmitting line 127 when the second optical sensor 123 is operated to detect the weight member 119 located between the remote position and the central position leads to the fact that the second displacement signal indicates the detecting period of the weight member 119 located between the remote position and the central position.

In step S402, the controlling unit 124 is operated to determine whether the start and end times of the detecting period of the first displacement signal each coincident with the start and end times of the detecting period of the second displacement signal or not. The fact that the controlling unit 124 is operated to determine whether the start and end times of the detecting period of the first displacement signal each coincident with the start and end times of the detecting period of the second displacement signal or not leads to the fact that the controlling unit 124 is operated to determine whether the phase difference between the first and second displacement signals is varied from the predetermined phase difference of 180 degrees or not.

When the controlling unit 124 is operated to determine that the start and end times of the detecting period of the first displacement signal each disaccord with the start and end times of the detecting period of the second displacement in step S402, the controlling unit 124 is operated to calculate the start and end time differences between the first and second displacement signals in step S403.

The start time difference calculated in step S403 is the difference when the start time of the detecting period of the second displacement signal is subtracted from the start time of the detecting period of the first displacement signal. This means that the start time difference is positive when the start time of the detecting period of the first displacement signal is delayed from the start time of the detecting period of the second displacement signal, while the start time difference is negative when the start time of the detecting period of the first displacement signal proceeds from the start time of the detecting period of the second displacement signal.

The end time difference calculated in step S403 is also the difference when the end time of the detecting period of the second displacement signal is subtracted from the end time of the detecting period of the first displacement signal. This means that the end time difference is positive when the end time of the detecting period of the first displacement signal is delayed from the end time of the detecting period of the second displacement signal, while the end time difference is negative when the end time of the detecting period of the first displacement signal proceeds from the end time of the detecting period of the second displacement signal.

In step S404, the controlling unit 124 is operated to determine whether the signs of the start and end time differences coincident with each other or not. When the controlling unit 124 is operated to determine that the signs of the start and end time differences coincident with each other in step S404, the controlling unit 124 is operated to determine whether the absolute values of the start and end time differences coincident with each other or not in step S405.

When the controlling unit 124 is operated to determine that the absolute values of the start and end time differences disaccord with each other in step S405, the controlling unit 124 is operated to determine that the phase difference between the first and second displacement signals is varied from the predetermined phase difference of 180 degrees, resulting from the fact that the frequency of the piston unit 107 is varied from the frequency of the weight member 119, and the displacement of the piston unit 107 is eccentric to the neutral position of the piston unit 107 as the offset of the piston unit 107 in step S412.

When the controlling unit 124 is operated to determine that the signs of the start and end time differences disaccord with each other in step S404, the controlling unit 124 is operated to determine whether the absolute values of the start and end time differences coincident with each other or not in step S409.

When the controlling unit 124 is operated to determine that the absolute values of the start and end time differences disaccord with each other in step S409, the controlling unit 124 is operated to determine that the phase difference between the first and second displacement signals is varied from the predetermined phase difference of 180 degrees, resulting from the fact that the frequency of the piston unit 107 is varied from the frequency of the weight member 119, and the displacement of the piston unit 107 is eccentric to the neutral position of the piston unit 107 as the offset of the piston unit 107 in step S412.

In step S413, the controlling unit 124 is operated to calculate the varied value of the phase difference from the predetermined phase difference of 180 degrees. The varied value calculated in step S413 is the sum of the start and end time differences, divided by 2. The fact that the varied value calculated in step S413 is the sum of the start and end time differences, divided by 2 leads to the fact that the controlling unit 124 is operated to eliminate the signal component indicative of the offset of the piston unit 107 from the varied value of the phase difference from the predetermined phase difference of 180 degrees. This means that the controlling unit 124 is operated to eliminate the signal component indicative of the offset of the piston unit 107 from the first displacement signal produced by the first optical sensor 122 when the offset of the piston unit 107 is detected by the controlling unit 124.

In step S414, the controlling unit 124 is operated to control the driving frequency of the electromagnet 111*a* of the linear motor 111 on the basis of the varied value of the phase difference from the predetermined phase difference of 180 degrees at the end. This means that the controlling unit 124 is operated to control the frequency of the piston unit 107 for one cycle of the reciprocally linear motion of the piston unit 107 to ensure that the piston unit 107 is operated to perform the reciprocally linear motion at the predetermined phase difference of 180 degrees as shown in FIG. 5. The fact that the piston unit 107 is operated to perform the reciprocally linear motion at the predetermined phase difference of 180 degrees leads to the fact that the vibrations of the fixed member 103 are damped by the dynamic damper 117 when the piston unit 107 is driven by the linear motor 111.

As will be seen form the foregoing description, the fact that the controlling unit is designed to control the driving frequency of the linear motor to have the piston unit, i.e., the single piston unit, perform the reciprocally linear motion at the predetermined phase difference leads to the fact that the linear compressor according to the present invention makes it possible (1) to prevent the vibrations of the fixed member from being caused by the reciprocally linear motion of the single piston unit forming part of the linear compressor, (2) to be reduced in size, and (3) to be simple in construction and thus inexpensive in production cost.

While the present invention has thus been shown and described with reference to the specific embodiments, however, it should be noted that the invention is not limited to the details of the illustrated structures but changes and modifications may be made without departing from the scope of the appended claims.

What is claimed is:

1. A linear compressor, comprising:

a fixed member formed with a hermetically sealed compression chamber to receive a working fluid therein;

a movable member axially movably received in said compression chamber of said fixed member, said movable member axially movably supported by said fixed member to have said movable member axially move in said compression chamber of said fixed member;

a plurality of resilient members each intervening between said fixed member and said movable member to have said fixed member and said movable member resiliently connected with each other;

said movable member being axially movable with respect to said fixed member under a reciprocally linear motion to assume three different positions consisting of a compression position in which said working fluid is compressed by said movable member, a decompression position in which said working fluid is decompressed by said movable member, and a neutral position in which said movable member is resiliently retained by said resilient members with respect to said fixed member under no influence of said working fluid in said compression chamber of said fixed member;

driving means for driving said movable member at a predetermined driving frequency to have said movable member per-form said reciprocally linear motion;

damping means for damping vibrations of said fixed member caused by said reciprocally linear motion of said movable member, said damping means including a retaining member fixedly connected to said fixed member, a weight member axially movably supported by said retaining member to resonate out of phase with said vibrations of said fixed member, and a resilient member intervening between said retaining member and said weight member to have said retaining member and said weight member resiliently connected with each other;

first detecting means for detecting a displacement of said movable member with respect to said fixed member, said first detecting means being operative to produce a first displacement signal indicative of said displacement of said movable member;

second detecting means for detecting a displacement of said weight member with respect to said retaining member, said second detecting means being operative to produce a second displacement signal indicative of said displacement of said weight member; and controlling means for controlling said predetermined driving frequency of said driving means to have said movable member perform said reciprocally linear motion at a predetermined phase difference between said first displacement signal produced by said first detecting means and said second displacement signal produced by said second detecting means to ensure that said vibrations of said fixed member are damped by said damping means when said movable member is driven by said driving means.

2. A linear compressor as set forth in claim 1, which further comprises an offset detecting means for detecting an offset of said movable member with respect to said neutral position of said movable member based on said first displacement signal produced by said first detecting means and second displacement signal produced by said second detecting means, said offset detecting means being operative to eliminate a signal component indicative of said offset of said movable member from said first displacement signal produced by said first detecting means when said offset of said movable member is detected by said offset detecting means.

3. A linear compressor as set forth in claim 1, in which the amplitudes of said movable member and said weight member are coincident with each other.

4. A linear compressor as set forth in claim 1, in which said first detecting means includes an optical sensor having a photo emitter for emitting a light beam and a photo detector for detecting said light beam emitted from said photo emitter to said photo detector, said optical sensor being operative to produce said first displacement signal when said light beam emitted from said photo emitter to said photo detector passes over said movable member.

5. A linear compressor as set forth in claim 1, in which said second detecting means includes an optical sensor having a photo emitter for emitting a light beam and a photo detector for detecting said light beam emitted from said photo emitter to said photo detector, said optical sensor being operative to produce said second displacement signal when said light beam emitted from said photo emitter to said photo detector is interrupted by said weight member.

6. A linear compressor as set forth in claim 1, in which said first detecting means includes an optical sensor having a photo emitter for emitting a light beam and a photo detector for detecting said light beam emitted from said photo emitter to said photo detector, said optical sensor being operative to produce said first displacement signal when said light beam emitted from said photo emitter to said photo detector passes over said movable member, and in which said second detecting means includes an optical sensor having a photo emitter for emitting a light beam and a photo detector for detecting said light beam emitted from said photo emitter to said photo detector, said optical sensor being operative to produce said second displacement signal when said light beam emitted from said photo emitter to said photo detector is interrupted by said weight member.

7. A linear compressor as set forth in claim 1, in which each of said resilient members includes a plurality of leaf springs each having a plane extending perpendicular to the center axis of said movable member, each of said resilient members having a first portion fixedly connected to said movable member, and a second portion fixedly connected to said fixed member to ensure that said movable member is resiliently urged with respect to said fixed member toward said neutral position while said movable member is axially moved to said compression position and said decompression position thereof.

8. A linear compressor as set forth in claim 1, in which said driving means includes a linear motor having a first magnet unit in the form of an annular shape and mounted on said piston unit, and a second magnet unit in the form of an annular shape and supported by said fixed member, said first and second magnet units having respective center axes each held in coaxial relationship with the center axis of said movable member, and respective center planes each perpendicular to the center axis of said movable member, said center plane of said first magnet unit being on said center plane of said second magnet unit when said movable member assumes said neutral position.

9. A linear compressor as set forth in claim 8, in which said first and second magnet units are constituted by an electromagnet and a permanent magnet, respectively, to ensure that said movable member is driven by said linear motor at said predetermined driving frequency of said electromagnet.

10. A linear compressor as set forth in claim 1, in which said damping means is connected to the fixed member with the center axis of said weight member held in axial alignment with the center axis of said movable member.

11. A linear compressor as set forth in claim 1, in which said damping means is connected to the fixed member with the center axis of said weight member held in parallel relationship with the center axis of said movable member.

12. A linear compressor as set forth in claim 1, in which said predetermined phase difference is 180 degrees.

* * * * *